US005937916A

United States Patent [19]

Hoyaukin

[11] Patent Number: 5,937,916

[45] Date of Patent: Aug. 17, 1999

[54] MACHINE FOR JOINING TOGETHER ELONGATED OBJECTS

[76] Inventor: Peter Hoyaukin, Stagneliusvägen 42 II, S-112 57 Stockholm, Sweden

[21] Appl. No.: 09/011,022

[22] PCT Filed: Aug. 15, 1996

[86] PCT No.: PCT/SE96/01017

§ 371 Date: Feb. 5, 1998

§ 102(e) Date: Feb. 5, 1998

[87] PCT Pub. No.: WO97/07304

PCT Pub. Date: Feb. 27, 1997

[30] Foreign Application Priority Data

Aug. 18, 1995 [SE] Sweden ..... 9502878

[51] Int. Cl.[6] ..... B21F 27/08

[52] U.S. Cl. ..... 140/57; 140/119

[58] Field of Search ..... 140/57, 93.6, 119

[56] References Cited

U.S. PATENT DOCUMENTS

| | | | |
|---|---|---|---|
| 3,677,308 | 7/1972 | Sarff et al. | 140/119 |
| 3,880,204 | 4/1975 | Sarff et al. | 140/119 |

FOREIGN PATENT DOCUMENTS

| | | |
|---|---|---|
| WO 8404772 | 12/1984 | European Pat. Off. . |
| WO 8701313 | 3/1987 | European Pat. Off. . |
| WO 9206260 | 4/1992 | European Pat. Off. . |
| 4008222 | 9/1990 | Germany . |

*Primary Examiner*—Lowell A. Larson

*Attorney, Agent, or Firm*—Sughrue, Mion, Zinn, Macpeak & Seas, PLLC

[57] ABSTRACT

A machine for tying together elongated objects with the aid of a wire tie, and particularly for tying or lashing reinforcement rods, electric cables, or the like. The machine includes two jaws (7) which are pivotal in relation to one another and which have wire guiding surfaces. The jaws can be closed around the objects to be tied together, so as to enable the wire (8) to be advanced along the jaw guide surfaces and form the wire into a generally U-shaped wire tie surrounding the objects. The machine also includes a supportive device (4) which is intended to support against the elongated objects, and the jaws (7) are movable towards and away from the objects in relation to the supportive device (4). The jaws (7) can be rotated so as to twist the legs of the wire-tie together while the machine is supported against the elongated objects.

9 Claims, 5 Drawing Sheets

MACHINE FOR JOINING TOGETHER ELONGATED OBJECTS

BACKGROUND OF THE INVENTION

The present invention relates to a machine for tying together elongated objects with the aid of a wire tie, and particularly for lashing or tying together reinforcement rods or bars, electric cables or the like, wherein the machine includes two jaws which can be swung relative to one another and which are provided with curved, wire-guiding surfaces that are caused to surround or straddle the objects to be tied together to enable the wire to be advanced along the wire-guide surfaces such as to form the wire into a wire loop that essentially surrounds the objects, by virtue of opening the jaws subsequent to advancing the wire and then moving the jaws for re-closure of said jaws on opposite sides of the objects, wherein the machine includes a supportive device adapted to support against said objects, and wherein the jaws are movable towards and away from the objects in relation to said supportive device in forming said wire loop around said objects.

Traditionally, reinforcement rods, or bars, are tied to form a tied mesh reinforcement with the aid of simple, manually-operated tools, which is a very time-consuming task and therewith a costly process, and also entails work which can result quite easily in strain-induced injuries to the workmen involved. This is because when tying reinforcement rods to produce a tied mesh reinforcement for concrete slabs, concrete floors or the like, with the aid of earlier known machines, it is necessary for the workman to remain in a stooped position for prolonged periods of time, therewith placing the spine of the workman under great bodily stress and strain as well as other parts of the workman's body.

The reinforcement rods are normally tied with the aid of pliers or twisters, by means of which the ends of a generally U-shaped wire tie positioned manually around the reinforcing rods at their mutual points of intersection are twisted or wound together so as to provide a stable tie. Conventional tying of reinforcement rods also creates accident hazards, particularly when working on roofs, bridges and similar structures, owing to the stooped position in which the workman is forced to work, such hazardous working positions also placing the workman at the risk of falling.

Machines which enable reinforcement rods to be tied mechanically with the workman in an upright working position have also been earlier proposed.

One such machine is described in WO 87/02313, although one drawback with this machine is that it is difficult for the workman to decide in which position the machine shall be held when closing the jaws for the advancement of a wire. A similar problem occurs when the machine is later to be lifted, subsequent to opening the jaws for renewed closure of the jaws on the upper side of the reinforcement rods. If the machine is lifted too high, the wire will be drawn out of the jaws and therewith prevent the wire ends being twisted together. The use of a machine of this kind is also tiring, because the workman must constantly carry the full weight of the machine.

It is true that a machine taught by WO 84/04772 includes a support element which is intended to coact with the reinforcement rods when advancing the wire through the jaws, but it is necessary to lift the machine manually prior to twisting the wire-ends together and remove the support from the reinforcement rods since said support would otherwise be tied firmly to the rods by said wire. It is also difficult with this machine for the workman to decide the height to which the machine shall be lifted prior to commencing twisting of the wire-ends. If the machine is lifted too high, the ends of the wire will be drawn out of the jaws and therefore cannot be twisted together. Furthermore, a great deal of precision is required with such a machine in order to achieve firm lashing of the reinforcement rods, since it is necessary to constantly hold the machine at precisely the correct level or height above the rods and because this height must be adapted during the rod lashing operation. This machine is also heavy to work with, because the full weight of the machine must be supported by the workman during the moment of tying the rods together.

DE-A1-4 008 222 teaches a machine having a supportive element which includes a rotational body for gripping and entraining the wire ends as the body rotates. In this case, the wire-ends are not twisted together by the jaws, but require the presence of additional means. This machine is also sensitive to dirt and to careless handling, both of which are liable to damage the bearing surfaces on the front parts of the jaws.

WO 92/06260 teaches a machine which includes an internal supportive element. The wire tie cannot be stretched with the aid of the jaws of this machine, and neither can the wire-ends be twisted together with the aid of said jaws. Separate rotating elements are therefore required to this end.

SUMMARY OF THE INVENTION

A major object of the present invention is to provide a machine of the aforedescribed kind which enables the workman to tie reinforcement rods together while standing in an upright position, and which eliminates the aforesaid drawbacks of the known machines, among other things.

The present invention is based on the concept of achieving this object with a machine that includes a supportive device which can constantly rest against the reinforcement rods and support the weight of the machine, and which therewith forms a reference point for the end positions of the jaws both beneath and above the reinforcement rods in conjunction with producing a rod-surrounding wire loop or tie.

In this regard, a machine of the kind defined in the first paragraph of this document is characterized in that the supportive device is adapted to support against said elongated objects externally of the jaws, and in that means are provided for rotating the jaws such as to twist together the two legs of the wire tie with the machine supported against said objects.

A machine of this kind is able to produce extremely firm tying of two reinforcement rods for instance, since movement of the jaws and their positions in relation to the positions of the reinforcement rods are determined with the aid of the supportive device coacting with said rods. The workman is relieved of the need to support the full weight of the machine tying operations.

In one preferred embodiment of the invention, the jaws are adapted for displacement against the action of a spring force, to the position in which they shall be closed for the advancement of the wire along the guide surfaces on said jaws, and wherein, subsequent to the jaws having been reopened the spring force is adapted to return the jaws to the position in which they shall again be closed for twisting together the legs of the wire tie.

Thus, in the case of this embodiment, the jaws will automatically adopt an optimal position in relation to the reinforcement rods prior to twisting together the legs of the wire tie. There is thus no danger of the ends of the wire being withdrawn from the jaws.

In the case of a particularly preferred embodiment, the jaws are closed prior to advancing the wire, with the aid of a device which coacts with said elongated objects and which is connected to handle means via a pull rod or pull line with which the jaws can be re-closed and held pressed together with a desired force prior to and whilst twisting together the legs of the wire tie. This embodiment ensures that the wire is able press the reinforcement rods into hard abutment with one another whilst twisting said wire-ends.

Other features of the invention will be apparent from the following claims.

BRIEF DESCRIPTION OF THE DRAWINGS

The invention will now be described in more detail with reference to exemplifying embodiments thereof and also with reference to the accompanying drawings, in which.

DETAILED DESCRIPTION OF THE PREFERRED EMBODIMENTS

Figure 1:
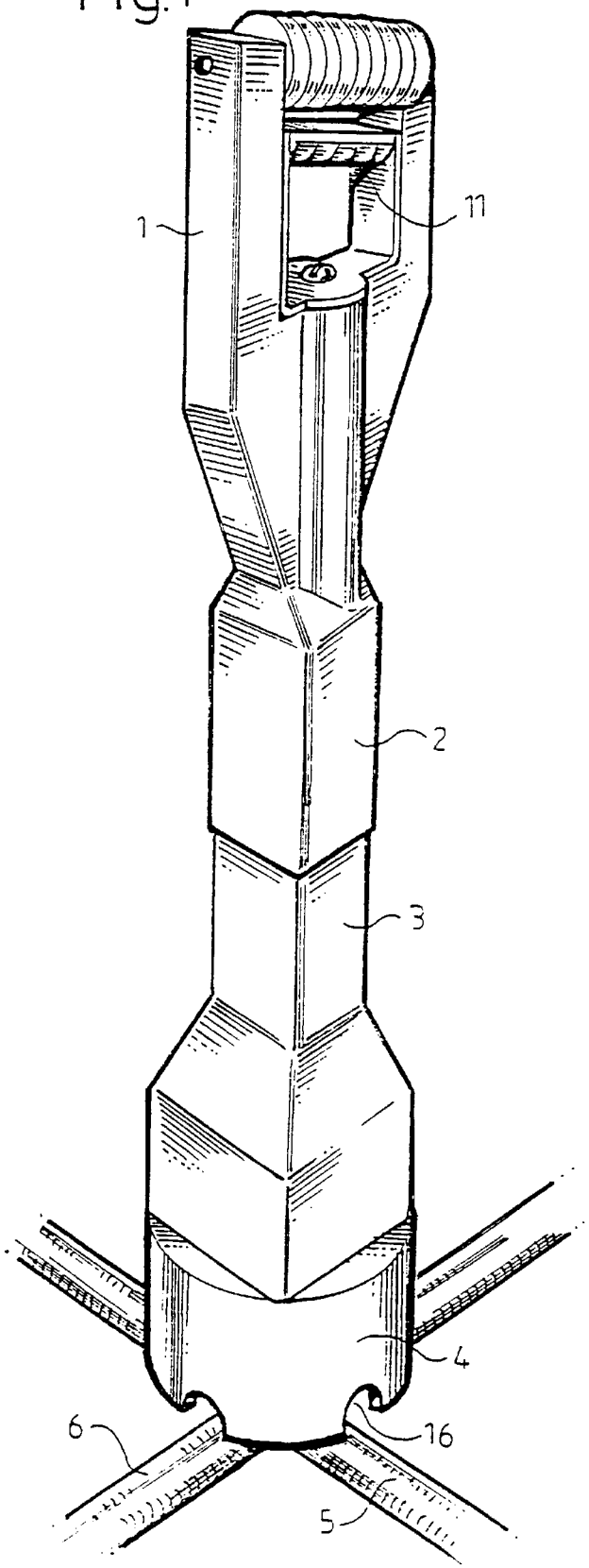
FIG. 1 is a schematic perspective view of an inventive machine intended for tying together reinforcement rods.
Figure 2:
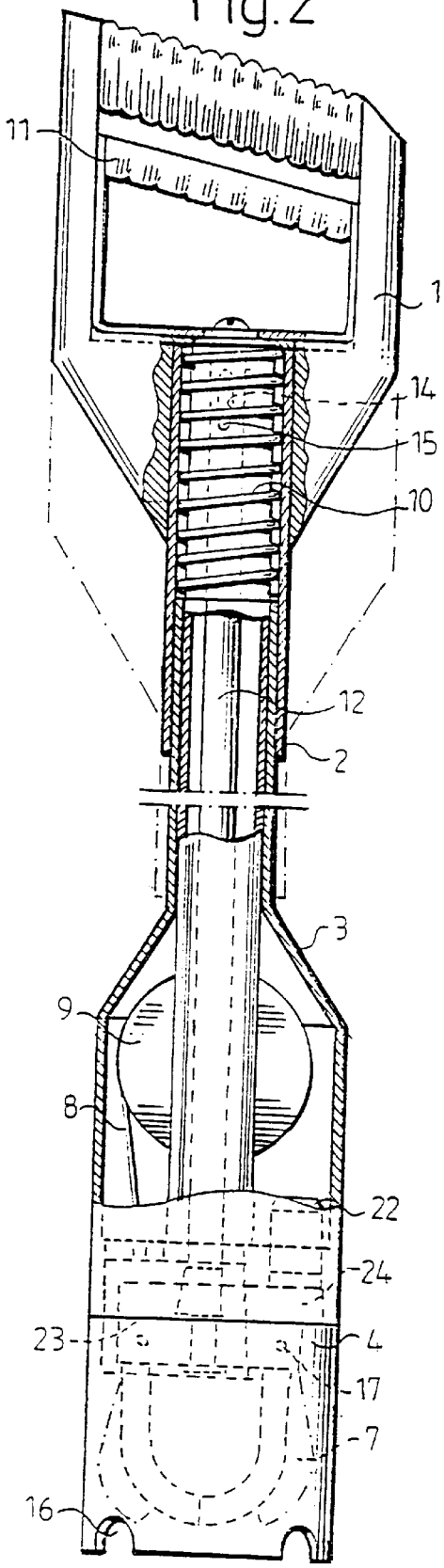
FIG. 2 illustrates the machine of FIG. 1 partially in section.

The tying machine illustrated in FIGS. 1 and 2 includes a handle 1 which merges with an outer tubular part 2 that can move telescopically in relation to an inner concentrical tube 3 which, in turn, merges with or is connected to a supportive device 4. The machine is intended to be supported during a working operation by the reinforcement rods 5, 6 that are to be tied or lashed together, i.e. by twisting together the legs of a wire tie that embraces the mutual point of intersection of the rods.

The machine is provided to this end with two pivotal jaws 7 which are normally open and which when the supportive device 4 rests on the rods 5, 6 can be displaced downwards in relation to said supportive device and closed together on the underside of the rods. This enables a tying wire 8 to be withdrawn from a storage reel 9 and fed through a passageway in the jaws 7. The jaws can then be reopened, moved upwards and then re-closed on the upper side of the rods. The wire is therewith cut and the jaws are then able to rotate so as to twist together the legs of the generally U-shaped wire tie thus formed.

Displacement of the jaws 7 and closing of the jaws on the underside of the rods 5, 6 is effected by depressing the handle 1 and the telescopic tube 2 in relation to the telescopic tube 3 carrying the supportive device 4; see the chain line position of the handle 1 in FIG. 2. This movement results in compression of a spring 10 provided in the handle. When the down-pressing force on the handle 1 is released, the spring 10 will return the handle to the position shown in full lines, and therewith also lift the jaws 7 to a position above the rods 5, 6 in which the jaws can be re-closed.

The aforedescribed function is achieved through the medium of a jaw holder device 23 which is connected to a generally U-shaped operating handgrip 11 in the handle 1, via an operating rod 12. The rod 12 is thus lifted when the operating handgrip 11 is pressed or pulled up. The operating rod 12 is tubular and accommodates a pull rod or pull line 13 as shown in FIG. 4A, for instance. The rod or line 13 accompanies movements of the rod 12, although with a certain degree of freedom in relation thereto. The rod 12 is provided to this end with slots 14 in which guide shoulders or pins 15 on the pull rod 13 run.

The supportive device 4 includes two pairs of diagonally opposed recesses 16, of which a pair of recesses coact with the uppermost reinforcement rod 16 in each rod tying operation so as to provide precise positioning of the machine in relation to the intersection points of the rods 5, 6.

An inventive machine and its method of operation will now be described in more detail with reference to the embodiment illustrated in FIGS. 3–6.

Figure 3:
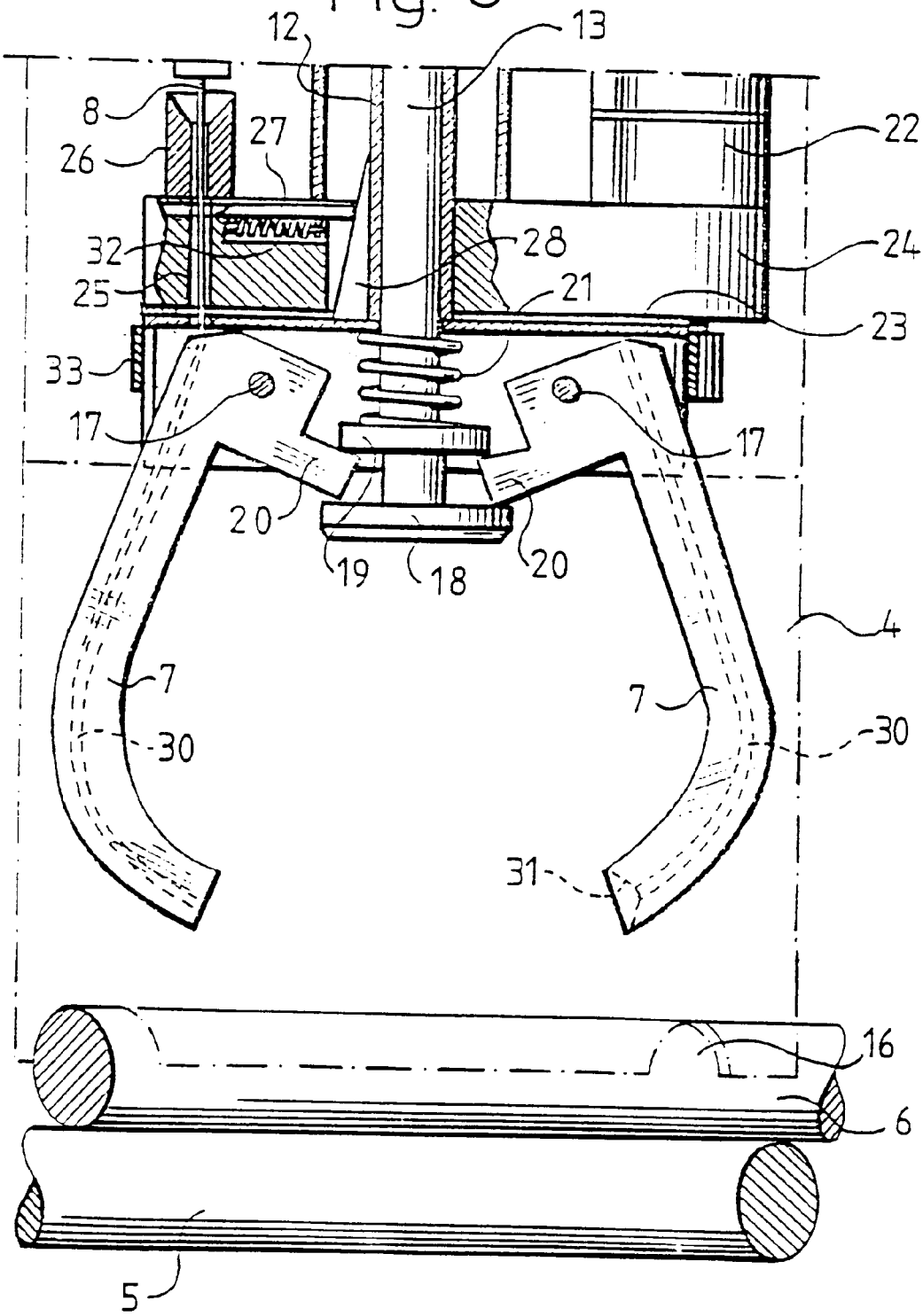
FIGS. 3–6 show parts of the machine, partly in section, during different working stages of a tying operation.

The machine is shown in FIG. 3 in a starting position with the supportive device 4 resting on the reinforcement rod 6 at its point of intersection with the underlying reinforcement rod 5, outwardly of the jaws 7. The jaws 7, which are pivotal about respective pivot points 17, are held open by two flanges 18, 19 provided on the pull rod 13 that runs through the tubular operating rod 12 and coacts with a projection 20 on respective jaws 7. The pull rod 13 is held in the illustrated position relative to the operating rod 12 by means of a spring 21.

The reference numeral 22 identifies an electric motor which is driven for rotation of the jaw holder means 23 by means of a battery (not shown) mounted in the handle. The overlying fixed part 24 includes a passageway 25 in which wire 8 taken from the reel 9 is advanced through the medium of a guide 26. The fixed part 24 carries a laterally movable cutter 27 which is actuated by a camming surface 28 on the operating rod 12 as the rod is lifted, so as to cut through the wire 8 located in the passageway 25. A cutter return spring is illustrated schematically at 32.

Figure 4:
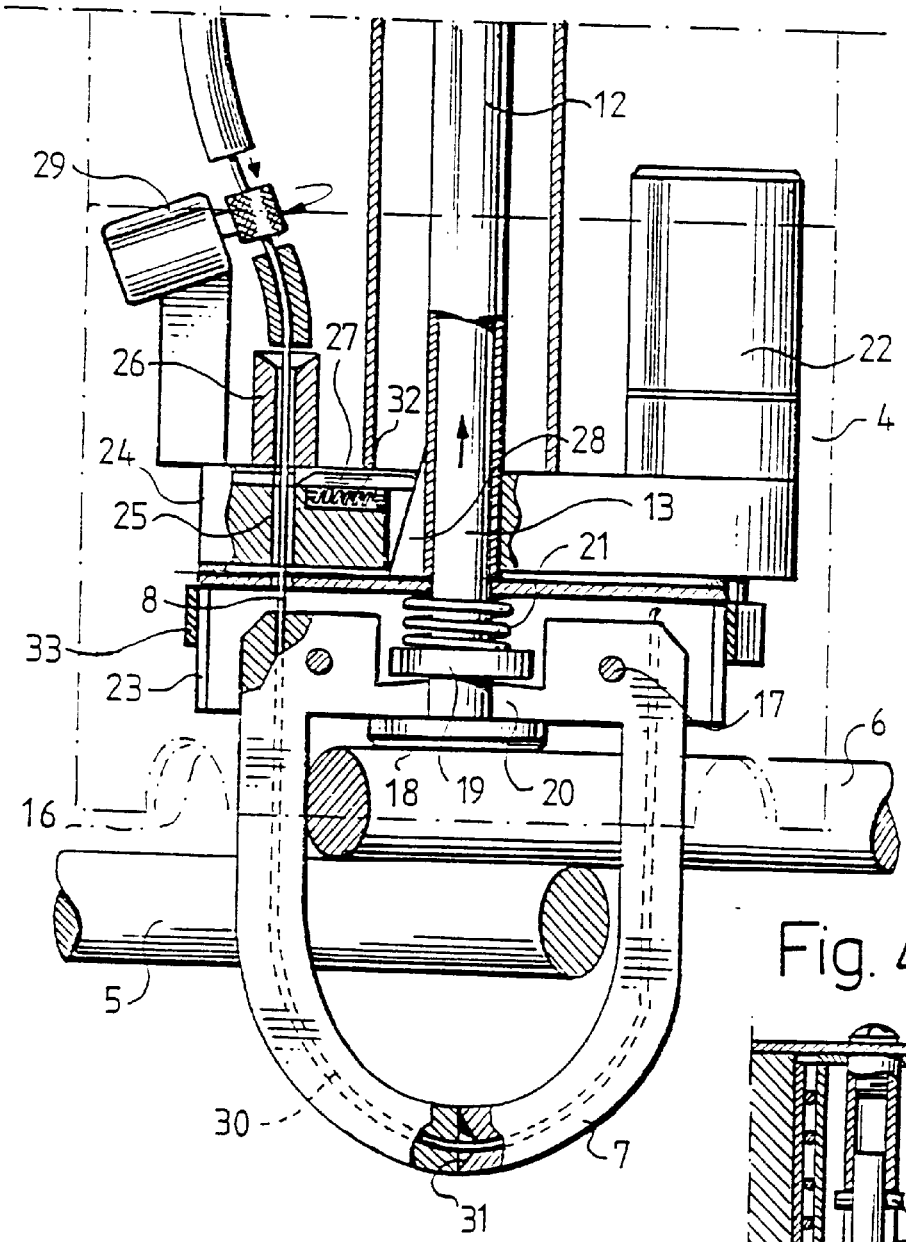
Figure 4A:
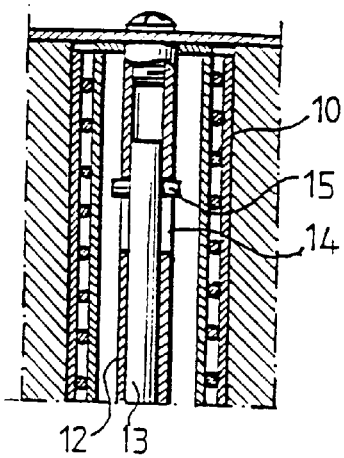

FIG. 4 illustrates the position reached when the jaws 7 and associated devices have been moved downwards in relation to the supportive device 4 and the reinforcement rods 5 and 6 as a result of pressing down the handle 1, until the ends of the jaws are located beneath the rods 5 and 6. The rods 5 and 6 therewith coact with the flange 18 to press the pull rod 13 upwards. The spring 21 has herewith been compressed and the jaws 7 closed as a result of the coaction of the flanges 18 and 19 with the projection 20 on respective jaws.

An electric motor 29 has therewith been activated and taken wire 8 from the reel 9 and fed the wire through a passageway 30 provided in the jaws 7. Guiding of the wire from the end of one jaw to the end of the other is facilitated by a conically narrowing guide surface 31 provided on the end of said second jaw.

As will be seen from FIG. 4A, the guide pins 15 on the pull rod have moved in the slots 14 in the operating rod towards the upper ends of said slots during upward movement of the pull rod 13 in relation to said rod 12.

Figure 5:
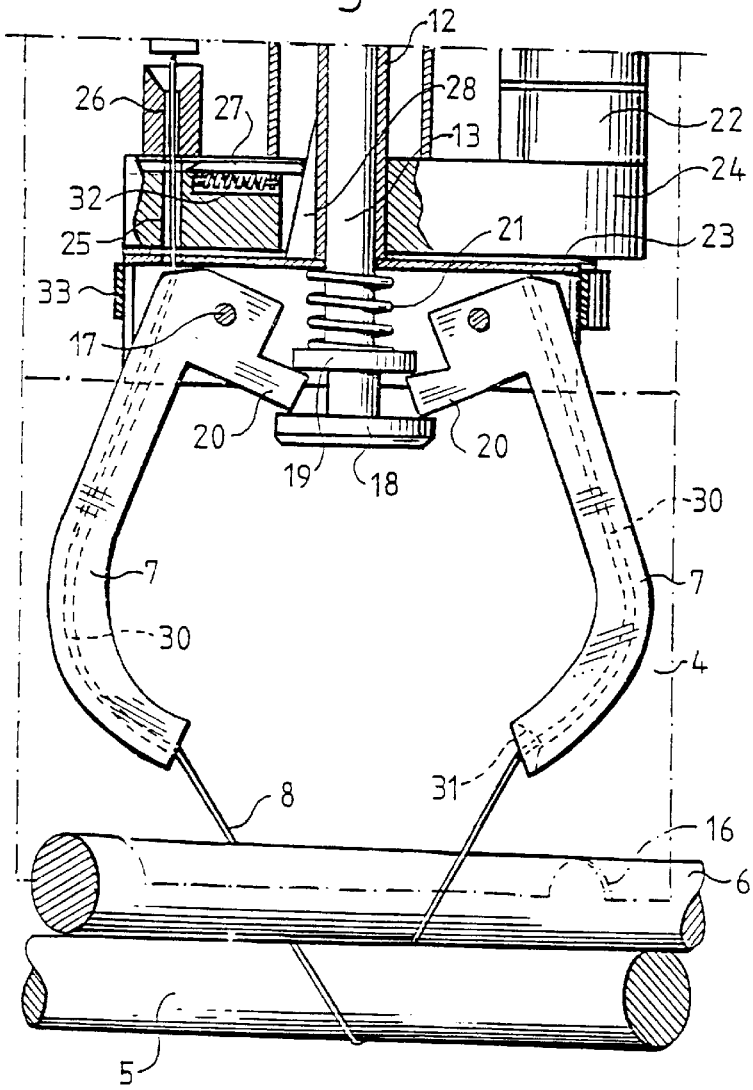

Subsequent to having fed the wire 8 through the jaws 7, the down-pressing force on the handle 1 is removed and the spring 10 therewith restores the jaws 7 and associated devices to their respective starting positions; see FIG. 5. The force exerted by the reinforcement rods 5, 6 on the flange 18 will therewith also cease, therewith enabling the spring 21 to force-out the pull rod 13, whereupon the jaws 7 are reopened as a result of the coaction between their projections 20 and the flanges 18 and 19. The wire 8 thus forms an open tie around the reinforcement rods 5, 6.

Figure 5A:
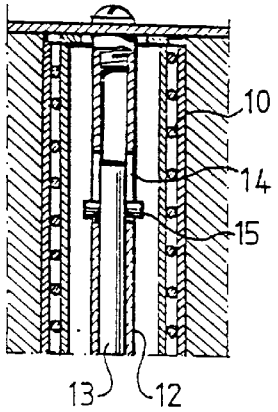

As shown in FIG. 5A, the guide pins 15 on the pull rod 13 will therewith be located at the bottom ends of the slots 14 in the hollow rod 12.

Figure 6:
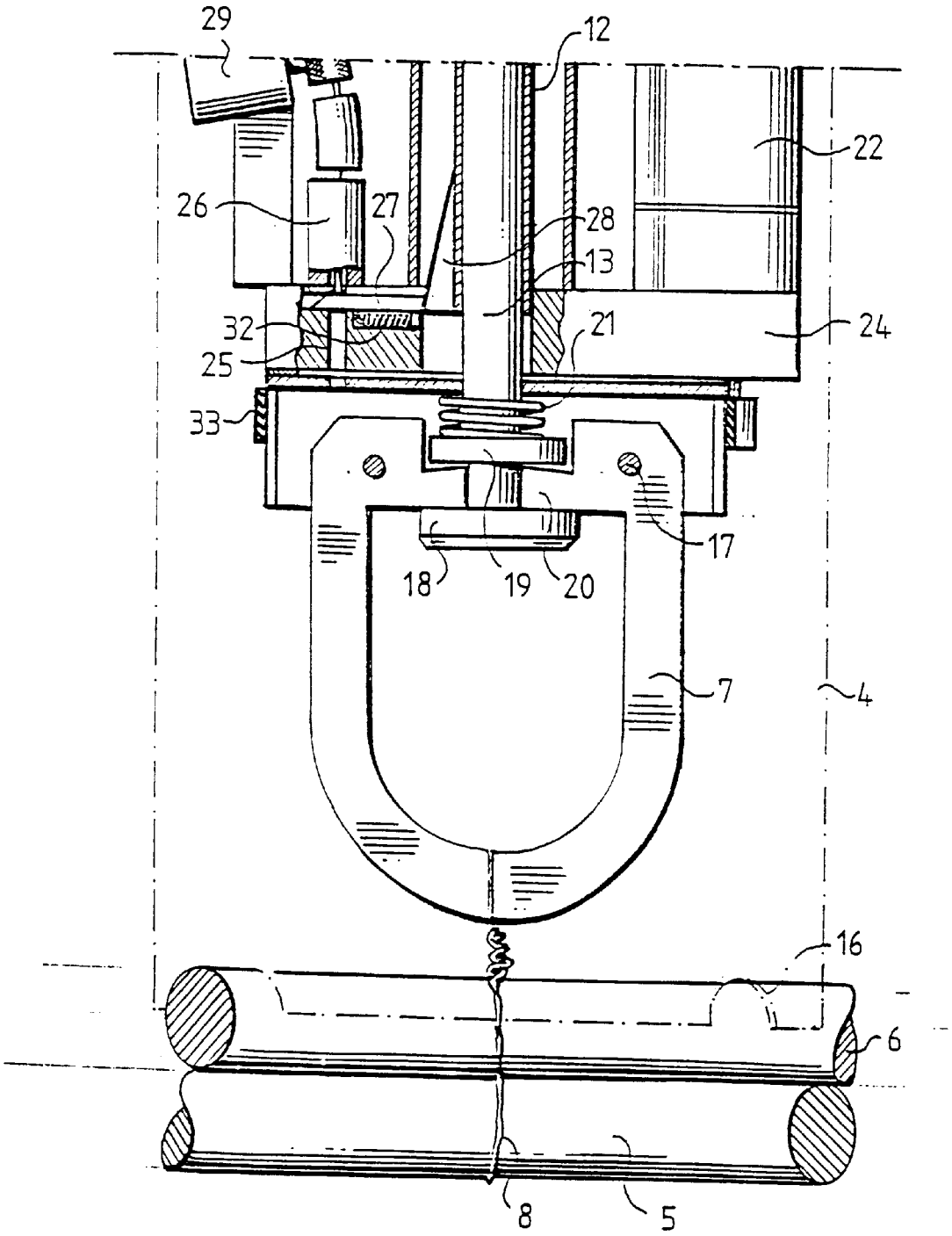

In this position, the operating handgrip 11 is pressed up so as to lift the rod 12 and its camming surface 28; see FIG. 6.

The camming surface will herewith force the cutter 27 to move laterally, so as to cut the wire 8 and compress the return spring 32. When the guide pins 15 are located at the bottom of respective slots 14, the pull rod 13 will also accompany upward movement of the rod 12 and therewith lift the flanges 18 and 19 for renewed closure of the jaws 7, while compressing the spring 21. The force at which the jaws 7 are pressed together is controlled by the force at which the handgrip 11 is pressed upwards, therewith enabling the jaws 7 to firmly press the legs of the wire tie between their end surfaces.

The motor 22 is started in this position and causes the jaw holder means 23 to rotate through a predetermined number of turns, e.g. through the medium of gearing 33, therewith causing the jaws to twist together the legs of the wire tie on the upper side of the reinforcement rods. The rods are therewith pressed into firm abutment with one another at the point of intersection of the rods. The quality of the tie or lashing can be improved by causing the jaws to approach the reinforcement rods during the tying moment.

When the jaws 7 have been rotated sufficiently to obtain effective lashing of the rods, the operating handgrip 11 is fully released, wherewith the spring 21 presses the pull rod 13 and the flanges 18 and 19 downwards. This results in reopening of the jaws in preparation for the next tying or lashing operation. The operating rod 12 and its camming surface 28 also participate in the downward movement of the pull rod 13, therewith enabling the return spring 32 to return the cutter 27, so that a new wire 8 can be fed down in the passageway 25.

Figure 7:
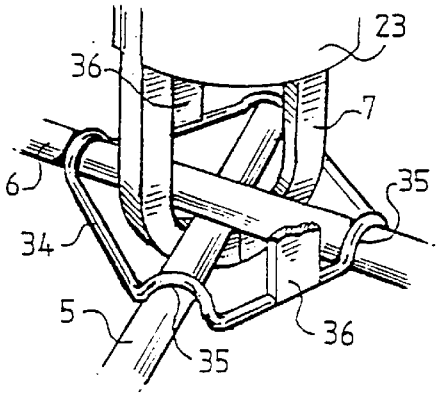
FIG. 7 illustrates an alternative embodiment of the machine supportive device.

FIG. 7 illustrates the machine provided with an alternative embodiment of the supportive device 4. In the case of this embodiment, the supportive device has the form of a rigid rod 34 provided with seatings 35 for the reinforcement rods 5, 6. The supportive device is attached to the inner tube 3 by means of stays 36. This embodiment enables the workman to position the machine precisely in its correct position in relation to the rod intersection points, since the workman's view is not obstructed by the supportive device.

Although the invention has been described above with reference to exemplifying embodiments illustrated in the accompanying drawings, it will be understood that modifications and changes can be made in several respects within the scope of the following claims. For instance, the jaw pivoting mechanism can be modified, both with respect to how the rotational movements are transferred to the jaws, and with respect to the design of the operating handgrip. The positions of the various springs can also be varied while retaining the aforedescribed function. Although the machine has been described with reference to lashing or tying reinforcement rods, the machine can also be used for a number of other purposes, as indicated in the introductory paragraph.

I claim:

1. A machine for tying together elongated objects with the aid of a wire tie, and particularly for tying together reinforcement rods, or bars, electric cables, or the like wherein the machine includes two jaws (7) which can be swung relative to one another and which include guide surfaces (30) for the wire (8) wherein the jaws can be caused to enclose the elongated objects (5, 6) to be tied together so as to enable the wire to be advanced along the wire-guide surfaces such as to form the wire into a wire loop which embraces or straddles said objects, by virtue of opening the jaws and moving said jaws subsequent to advancing said wire so that the jaws can be re-closed on the opposite side of said objects, wherein the machine also includes a supportive device (4; 34) which is intended to support against said objects (5, 6), and wherein the jaws (7) are movable towards and away from the objects in relation to said supportive device (4; 34) when forming said wire loop, wherein the supportive device (4; 34) is constructed to support against said objects externally of the jaws (7); the machine includes means (22, 23) for rotating the jaws (7) such as to twist together the two legs of the wire loop with the machine supported against the elongated objects (5, 6), the jaws (7) are constructed for displacement against the action of a spring force (10) to the position in which they shall be closed for advancement of the wire (8) along said guide surfaces (30); and subsequent to having opened said jaws the spring force (10) functions to return the jaws to the position in which they shall again be closed for mutual twisting of the legs of the wire-tie.

2. A machine according to claim 1, wherein displacement of the jaws (7) is effected by moving a machine handle part (1) in relation to said supportive device (4; 34).

3. A machine according to claim 1, wherein closing of the jaws (7) prior to advancement of the wire (8) is effected under the control of means (18) coacting with said elongated objects (5, 6), said coacting means also functioning to open the jaws when said jaws are returned.

4. A machine according to claim 3, wherein said coacting means (18) is displaced by said elongated objects (5, 6) against a jaw-closing spring force (21); and said spring force is adapted to reset said means for opening the jaws upon their return.

5. A machine according to claim 3, wherein, said coacting means (18) is connected to an operating handgrip (11) through the medium of a pull rod (13) or pull line by means of which the jaws (7) can be re-closed and pressed together with a desired force prior to mutually twisting the legs of the wire tie.

6. A machine for tying together elongated objects with the aid of a wire tie, and particularly for tying together reinforcement rods, or bars, electric cables, or the like wherein the machine includes two jaws (7) which can be swung relative to one another and which include guide surfaces (30) for the wire (8) wherein the jaws can be caused to enclose the elongated objects (5, 6) to be tied together so as to enable the wire to be advanced along the wire-guide surfaces such as to form the wire into a wire loop which embraces or straddles said objects, by virtue of opening the jaws and moving said jaws subsequent to advancing said wire so that the jaws can be re-closed on the opposite side of said objects, wherein the machine also includes a supportive device (4; 34) which is intended to support against said objects (5, 6), and wherein the jaws (7) are movable towards and away from the objects in relation to said supportive device (4; 34) when forming said wire loop, wherein the supportive device (4; 34) is constructed to support against said objects externally of the jaws (7); the machine includes means (22, 23) for rotating the jaws (7) such as to twist together the two legs of the wire loop with the machine supported against the elongated objects (5, 6), and the wire (8) used to form said wire tie is taken from a reel (9), and further comprising a wire cutter (27) which is actuated by an operating rod (12) that can be moved by an operating handgrip (11).

7. A machine according to claim 6, wherein the operating rod (12) has a camming surface (28) which coacts with the cutter (27) and which causes the cutter (27) to move generally perpendicularly upon axial movement of the operating rod (12).

8. A machine according to claim 6, wherein, a pull rod (13) or pull line is connected to the operating handgrip (11) through the medium of said operating rod (12).

9. A machine according to claim 8, wherein the operating rod (12) has the form of a tube which accommodates the pull rod (13) or pull line; and the tube has an axially extending slot (14) for receiving a dogging pin (15) projecting out from the pull rod (13) or said pull line, thereby providing a certain degree of relative movement between the pull rod, or pull line, and said tube.

* * * * *